US006681696B2

(12) United States Patent
Stephan

(10) Patent No.: US 6,681,696 B2
(45) Date of Patent: Jan. 27, 2004

(54) TURNING OR REVERSING DEVICE WITH A STORAGE DEVICE FOR FLAT OR SHEET-LIKE MATERIAL

(75) Inventor: Günther Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/017,634

(22) Filed: Nov. 21, 2001

(65) Prior Publication Data

US 2002/0139262 A1 Oct. 3, 2002

(30) Foreign Application Priority Data

Nov. 21, 2000 (DE) ..... 100 57 569

(51) Int. Cl.[7] ..... B41F 5/02

(52) U.S. Cl. ..... 101/231; 101/232; 101/409; 101/483; 271/186; 271/277; 271/309; 271/314

(58) Field of Search ..... 101/407.1, 409, 101/231, 232, 142, 177, 483; 271/65, 186, 277, 309, 314

(56) References Cited

U.S. PATENT DOCUMENTS

| | | | | | |
|---|---|---|---|---|---|
| 4,099,463 | A | * | 7/1978 | Zimmermann et al. | 101/230 |
| 4,165,689 | A | * | 8/1979 | Giuiuzza | 101/230 |
| 4,327,641 | A | * | 5/1982 | Goodwin et al. | 101/144 |
| 4,688,784 | A | * | 8/1987 | Wirz | 271/195 |
| 4,930,414 | A | * | 6/1990 | Wirz | 101/183 |
| 5,089,857 | A | * | 2/1992 | Xydias | 399/401 |
| 5,134,938 | A | | 8/1992 | Büsse et al. | |
| 5,598,779 | A | * | 2/1997 | Haas et al. | 101/230 |
| 5,687,964 | A | * | 11/1997 | Stephan et al. | 271/195 |
| 6,477,951 | B2 | * | 11/2002 | Fujimoto | 101/232 |

FOREIGN PATENT DOCUMENTS

| | | |
|---|---|---|
| DE | 40 30 070 C2 | 3/1992 |
| DE | 41 40 762 A1 | 6/1993 |
| DE | 44 24 967 C2 | 1/1996 |
| DE | 44 24 968 | 1/1996 |
| DE | 196 35 389 A1 | 3/1998 |

OTHER PUBLICATIONS

Search Report issued by the German Patent and Trademark Office in Oct. of 2000.

* cited by examiner

*Primary Examiner*—Daniel J. Colilla
*Assistant Examiner*—Jill E. Culler
(74) *Attorney, Agent, or Firm*—Laurence A. Greenberg; Werner H. Stemer; Gregory L. Maybeck

(57) ABSTRACT

Provided, in combination, is a device for turning sheet-like material, with an impression cylinder for guiding the sheet-like material, the impression cylinder being preceded by a first transfer cylinder and followed by a second transfer cylinder, the sheet-like material being receivable on an outer jacket surface of the impression cylinder so as to be printable by a third transfer cylinder, and further included are a storage device, and a device for imparting a deformation in the sheet-like material during entry thereof into the storage device and while the sheet-like material is gripped at an edge thereof; and a printing unit and a multicolor rotary printing machine, respectively, provided with the combination.

1 Claim, 4 Drawing Sheets

TURNING OR REVERSING DEVICE WITH A STORAGE DEVICE FOR FLAT OR SHEET-LIKE MATERIAL

BACKGROUND OF THE INVENTION

Field of the Invention

The invention relates to a turning or reversing device for a real or flat sheet-like material, which is printable on both sides thereof, with a storage device for the sheet-like material to be turned, which is assigned to the turning device.

The published German Patent Document DE 41 40 762 A1 is concerned with a sheet guiding device which may be used selectively in recto and verso printing mode, a respective sheet being turnable by this device, during recto and verso printing, in accordance with the principle of sheet trailing-edge turning, and pneumatically operating and mechanical devices are provided under the impression cylinder preceding the turning drum. In order to provide a sheet guiding device by which the sheet can be guided and led in a smudge-free manner in the turning or reversing phase, without formation of a sheet wad, the impression cylinder has assigned thereto, at an angle of inclination β, a guide doctor blade capable of being acted upon pneumatically and provided with individual air outlet orifices. After impression cylinder grippers have opened, the printed sheet is released from the printing surface of the cylinder by blowing or blast air, steered under the guide plate and both held up and transported in the direction of the transfer cylinder by the emerging blowing air, until the turning drum conveys the sheet farther on.

The published German Patent Document DE 44 24 967 C2 is concerned with a method and a device for sheet turning or reversing. What is proposed is a method for sheet turning based upon the principle of trailing edge turning in sheet-fed rotary printing machines capable of being converted from recto printing to recto and verso printing mode, in which method, in recto and verso printing, a print carrier sheet guided on a cylinder is gripped at the trailing edge thereof by a pivotable sheet take-over system of a turning drum following or located downline from the cylinder, at the tangent point of the turning drum and the cylinder, and is transported further. At the tangent point, the start of the sheet carrier sheet is released by the sheet gripper of the cylinder and, immediately after or downline from the tangent point, is guided on a path deviating from the surfaces of the cylinder under the turning drum.

Storage of sheet-like material on the impression cylinders of a rotary printing machine requires free space below the impression cylinder, so that the sheet-like material can be received over the entire length thereof. Thus, the sheet can be gripped and turned by the turning drum without coming into contact with machine parts, casings of transfer drums, guide plates or other sheets. The requirement for storage space is contradictory or opposed to the requirement that the sheet-like material should be printed out during the transfer in recto printing mode to the transfer drum following the impression cylinder. If the sheet-like material is intended to have already left the printing nip during transfer in recto printing, it is necessary, in printing units with a single-drum turning device, to provide in each case a complete length of the maximum processable printing format as a freely available sheet transport stage both between the transmission cylinder and the gripper median line to a following or downline transfer drum and between the following or downline transfer drum and the transfer median line to the preceding or upline transfer drum, taking into account the collision space of the fittings provided thereat. Furthermore, it is also necessary to take into account the necessary space requirement for accessibility and for the fittings in front of or upline from the printing nip.

A further possibility for solving the depicted technical problem is to pivot the arrangement of cylinders to an extent that the construction space for printing out and storage is gained at the expense of the fittings in front of or upline from the printing nip. This measure, however, is detrimental to the quality of sheet guidance in front of or upline from the printing nip, so that the print quality which is attained decreases. Moreover, serious effects on the accessibility of the fittings are to be feared. This makes it difficult to clean, perform settings and conduct servicing during maintenance work.

A further possibility for a remedy is to restrict the permissible print carriers for the recto and verso printing mode to those print carriers which remain adhering to the circumference of the impression cylinder and which do not move away from the impression cylinder due to the influence of gravity and to flexural rigidity. By this measure, the collision space to be kept free could be restricted and the permissible format length could be enlarged. However, the restriction to only some permissible print carriers for rotary printing machines with turning devices is seriously detrimental to the processable print carriers and can only be a compromise solution.

SUMMARY OF THE INVENTION

In view of the developments in the prior art, which have been outlined, and the technical problem, which has been described, it is an object of the invention to provide a turning or reversing device with a storage device for flat sheet-like material wherein the storable sheet length is maximized during the turning or reversing of the sheet-like material.

With the foregoing and other objects in view, there is provided, in accordance with a first aspect of the invention, in combination, a device for turning sheet-like material, with an impression cylinder for guiding the sheet-like material, the impression cylinder being preceded by a first transfer cylinder and followed by a second transfer cylinder, the sheet-like material being receivable on an outer jacket surface of the impression cylinder so as to be printable by a third transfer cylinder, comprising a storage device, and a device for imparting a deformation in the sheet-like material during entry thereof into the storage device and while the sheet-like material is gripped at an edge thereof.

In accordance with another feature of the invention, the storage device extends below the impression cylinder and the first and the second transfer cylinders.

In accordance with a further feature of the invention, the storage device has a contour for guiding a print carrier, the contour corresponding to a wedge-shaped region between two of the cylinders which are mutually cooperating.

In accordance with an added feature of the invention, the storage device has, below the impression cylinder, a nip width narrowing continuously in a direction of entry of the sheet-like material.

In accordance with an additional feature of the invention, the storage device has a run-on slope in a wedge-shaped region of the nip.

In accordance with yet another feature of the invention, the combination includes a retaining element arranged at the storage device in an upper region thereof, below a transfer median line, for retaining in the storage device the sheet-like material which has entered the storage device.

In accordance with yet a further feature of the invention, the retaining element has perforations formed therein like comb tines for allowing passage therethrough of holding elements of the impression cylinder for gripping the sheet-like material.

In accordance with yet an added feature of the invention, at least one coating is provided on the retaining element for damping impacts of the sheet-like material.

In accordance with yet an additional feature of the invention, the combination includes an encapsulated damping gel provided on the retaining element.

In accordance with still another feature of the invention, the combination includes cyclically activatable blowing nozzles provided on the impression cylinder for ejecting the sheet-like material into the retaining element.

In accordance with still a further feature of the invention, the combination includes cyclically activatable ejector pins provided on the impression cylinder for ejecting the sheet-like material into said retaining element.

In accordance with still an added feature of the invention, the combination includes free jet devices actable free of contact on a side of the sheet-like material yet to be printed, for imparting a deformation in the sheet-like material for maximizing the storable length thereof.

In accordance with still an additional feature of the invention, the combination includes a blast device for discharging free jets, the blast device being received in a gap formed in the impression cylinder.

In accordance with another feature of the invention, the combination includes gripping devices of the transfer cylinder following the impression cylinder, the gripping devices serving for fixing the sheet-like material at one edge during entry of the sheet-like material into a storage device.

In accordance with a further feature of the invention, the gripping devices are pivotable about an axis thereof for imparting to the sheet-like material a bending moment for deforming the sheet-like material.

In accordance with an added feature of the invention, the gripping devices serve for executing a yielding movement retreating behind a path of an edge of the sheet-like material, within an enveloping curve of the transfer cylinder following the impression cylinder.

In accordance with an additional feature of the invention, a change in distance between a gripper path of the gripping devices and an outer jacket surface of the transfer cylinder following the impression cylinder is variable during rotation of the impression cylinder and the transfer cylinder following the impression cylinder for guiding a print carrier.

In accordance with another aspect of the invention, there is provided a printing unit with a device for turning sheet-like material, and including an impression cylinder for guiding the sheet-like material, the impression cylinder being preceded by a first transfer cylinder and followed by a second transfer cylinder, the sheet-like material being receivable on an outer jacket surface of the impression cylinder so as to be printable by a third transfer cylinder, comprising a storage device, and a device for imparting a deformation in the sheet-like material during entry thereof into the storage device and while the sheet-like material is gripped at an edge thereof.

In accordance with a concomitant aspect of the invention, ther is provided a multicolor rotary printing machine with a device for turning sheet-like material from a printed side onto a side yet to be printed, and including an impression cylinder for guiding the sheet-like material, the impression cylinder being preceded by a first transfer cylinder and followed by a second transfer cylinder, the sheet-like material being receivable on an outer jacket surface of the impression cylinder so as to be printable by a third transfer cylinder, comprising a storage device, and a device for imparting a deformation in the sheet-like material during entry thereof into the storage device and while the sheet-like material is gripped at an edge thereof.

The advantages of the construction proposed in accordance with the invention are, above all, that the print carrier, whether paper or cardboard, is deformed out of position around the impression cylinder after a take-over of an edge of the sheet-like material by the grippers of a transfer cylinder following or downline from the impression cylinder. The deformation of the sheet-like material achieves a better utilization of the storable sheet length, in that, in this regard, the sheet-like material can be curved so that even a wedge-shaped region below a transfer median line between two mutually cooperating cylinders guiding a print carrier can be utilized as storage space. The storage device which, according to the invention, projects into the wedge-shaped region of two mutually cooperating cylinders guiding sheet-like material, is configured so that the surface thereof is at a maximum and can therefore store even the maximum processable format.

In an advantageous development of the idea upon which the invention is based, the storage device extends over the entire printing unit length below the cylinders guiding the sheet-like material. Thus, a continuous surface can be formed below the cylinders guiding the sheet-like material, so that an integral or one-piece construction of the storage device configured in accordance with the invention can be produced advantageously in terms of manufacturing technology.

The storage device has a contour corresponding to the wedge-shaped region of two mutually cooperating cylinders and therefore has an at least approximately triangular configuration in the upper region thereof extending into the wedge-shaped region. This configuration ensures the use of the continuously narrowing cylinder wedge in a direction towards the transfer median line of the impression cylinder and the preceding transfer cylinder. The end point of the storage device configured in accordance with the invention is determined by the maximum processable sheet format to be turned, which must be received in a curved position by the storage device.

The storage device below the impression cylinder has a nip profile narrowing continuously in the direction of entry of the sheet-like material, which narrows continuously in the direction of the wedge-shaped region delimited by the transfer median line between the impression cylinder and the preceding transfer cylinder. With the continuous narrowing of the nip width, the respective leading edge of the sheet-like material enters the storage device over as great a width as possible as far as the wedge-shaped region. The entry operation into the storage device, which takes place in the direction of rotation of the impression cylinder, is also assisted by the storage device, which is provided triangularly with a run-on slope in the wedge-shaped region of the two mutually cooperating cylinders. The previous sheet leading edge, now the new sheet trailing edge, runs up into the wedge-shaped region at the run-on slope, thus ensuring that the entire surface of the storage device, which faces the outer jacket surface of the impression cylinder, can be utilized as storage length.

Advantageously, the storage device may include, in an upper region thereof, but below the transfer median line between the impression cylinder and the preceding transfer cylinder, a retaining element which protects the sheet-like material entering the storage device against entry into the cylinder nip between the impression cylinder and the preceding transfer cylinder feeding the sheet-like material to the latter. The retaining element has provided therein, on the one hand, perforations in the manner of comb tines, which allow passage for gripper elements disposed on the outer jacket surface of the impression cylinder. Furthermore, at least one coating, for example of rubber or of other resilient materials, which damp the entry of the sheet-like material into the storage device, may be provided on the retaining element. In addition to the use of rubber or other elastic materials, the retaining element may have provided thereon an encapsulated damping gel, the consistency of which to a very great extent determines the damping behavior. The retaining element is preferably constructed so that it is provided, at the upper end thereof facing towards the transfer median line between the impression cylinder and the preceding transfer cylinder, with a hook-shaped over-engaging or overlapping portion which ensures that the sheet-like material which has entered the storage device does not project into the printing nip between the impression cylinder and the preceding transfer cylinder and is not gripped thereby.

According to a further realization of this concept upon which the invention is based, the impression cylinder may be provided with ejector elements for causing the sheet-like material to be ejected into the retaining device engaging over or overlapping the end of the sheet-like material which is in the form of extendable pins or blast nozzles which are activatable preferably in a cyclic manner and are activated whenever the sheet-like material has as far as possible entered the cylinder wedge of the impression cylinder and the preceding transfer cylinder.

In another realization of the concept upon which the invention is based, a deformation maximizing the storable length can be imparted to the sheet-like material by free jets acting contactlessly on that side of the sheet-like material which is yet to be printed.

During the entry of the sheet-like material into the storage device configured in accordance with the invention, the material is fixed at one edge by gripping devices of the following transfer cylinder, i.e., the turning or reversing drum. The gripping devices may be constructed as tongs grippers pivotable about the axis thereof. In an alternative version of the idea upon which the invention is based, by gripping devices arranged pivotably about the axis thereof in the following transfer cylinder, a bending moment causing deformation can be introduced to the sheet-like material entering the storage device into the continuously narrowing nip between the outer surface and the curved storage length.

In an alternative embodiment of the idea upon which the invention is based, the gripping devices which have gripped a sheet edge of the sheet-like material to be turned or reversed, execute, on the transfer cylinder functioning as a turning drum and following the impression cylinder, a yielding movement retreating behind the path of a sheet edge. The yielding movement of the gripper path on the transfer cylinder functioning as a turning drum and following the impression cylinder results, during the rotation of the turning drum and the impression cylinder, in a change in distance between the instantaneous gripper position and the outer jacket surface during the rotation of the two cylinders.

The storage device proposed according to the invention can be used particularly and preferably in the case of rotary printing machines processing relatively flexurally rigid material, such as for example, cardboard or pasteboard. In addition to relatively flexurally rigid materials, standard print carriers, such as, for example, papers of heavier or lighter grammage, can also be turned or reversed without difficulty. Turning or reversing devices, to which the storage device configured according to the invention may be assigned, are used preferably on multicolor rotary printing machines which process sheet-like material.

Other features which are considered as characteristic for the invention are set forth in the appended claims.

Although the invention is illustrated and described herein as embodied in a turning or reversing device with a storage device for flat sheet-like material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
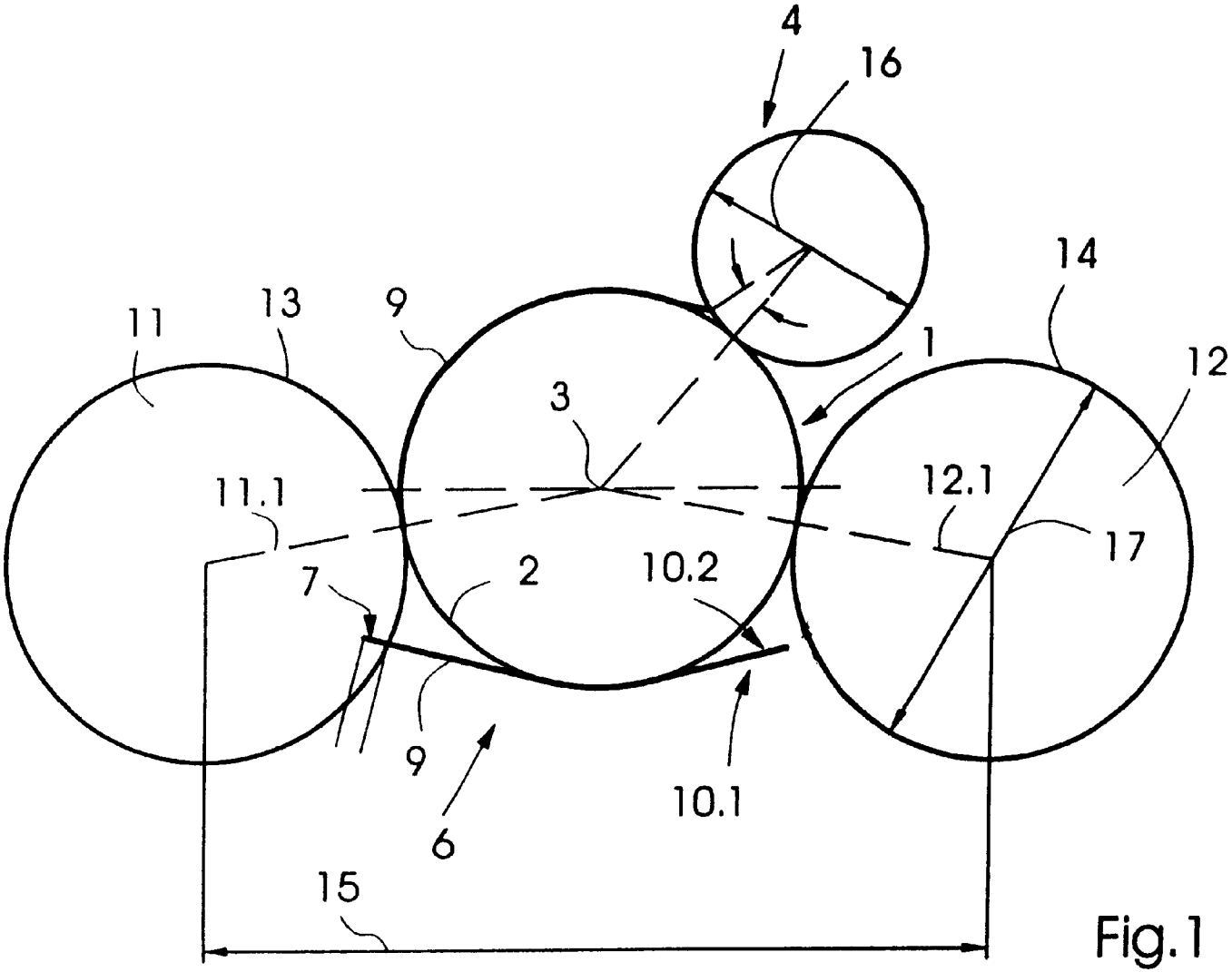
FIG. 1 is a diagrammatic side elevational view of a configuration of cylinders of a rotary printing machine, which includes a transfer cylinder preceding or located upline from an impression cylinder, as viewed in a travel direction of sheet-like material through the configuration of cylinders, and a transfer cylinder following or located downline from the impression cylinder.

Referring now to the drawings and, first, particularly to FIG. 1 thereof, there is shown therein a configuration of cylinders of a printing unit of a rotary printing machine, including a transfer cylinder 4 preceding or disposed upline from an impression cylinder 1, and a transfer cylinder 11 following or disposed downline from the impression cylinder 1.

The impression cylinder 1, on the outer jacket surface 2 of which, sheet-like material 9, whether of paper or of relatively flexurally rigid cardboard or pasteboard, is guided, has assigned thereto, on the one hand, the transfer cylinder 4 as well as the transfer cylinder 11 and another transfer cylinder 12. Axes of rotation of the transfer cylinders 11 and 12, respectively, lie slightly below an axis 3 of rotation of the impression cylinder 1. Transfer median lines 11.1 and 12.1, respectively, are shown extending between the axis of rotation of the transfer cylinder 12 and the axis 3 of rotation, and between the latter and the axis of rotation of the transfer cylinder 11 following or located downline from the impression cylinder 1. The transfer median lines 11.1 and 12.1 mark the points at which the sheet-like material 9 on an outer jacket surface 14 of the transfer cylinder 12 preceding or upline from the impression cylinder 1 goes over to the outer jacket surface 2 of the impression cylinder 1 and, respectively, the location at which the sheet-like material 9 goes over from the outer jacket surface 2 of the impression cylinder 1 to the outer jacket surface 13 of the transfer cylinder 11 following or located downline from the impression cylinder 1. The preceding or upline transfer cylinder 12 may also be, for example, a transfer cylinder having an outer jacket surface of oval shape.

In FIG. 1, there is located below the impression cylinder 1, between the transfer cylinders 11 and 12, a storage device 6, which is illustrated merely diagrammatically here, and has a copy of the sheet-like material 9 received therein. In the condition illustrated in FIG. 1, the sheet-like material 9 is positioned with a printed side 10.1 thereof facing outwardly or downwardly in the figure, while that side 10.2 of the sheet-like material 9 which is yet to be printed faces the outer jacket surface 2 of the impression cylinder 1 or upwardly in the figure. A distance 7 over which the previous trailing edge of the sheet-like material 9 is to be turned, now the sheet leading edge, is taken over in otherwise non-illustrated gripping devices, in the transfer cylinder 11 following or downline from the impression cylinder 1. The printing unit has a length 15 extending between the axes of rotation of the two transfer cylinders 11 and 12, each of which has a diameter 17 which amounts to double the diameter of the transfer cylinder 4.

A first different embodiment of the storage device 6 configured according to the invention, with a retaining element arranged in a wedge-shaped region below the transfer median line, is shown in greater detail in FIG. 2.

The storage device 6 covers the underside of the outer jacket surface 2 of the impression cylinder 1 and a region of the underside of the outer jacket surface 14 of the transfer cylinder 12 preceding or located upline from the impression cylinder 1. The storage device 6 is formed with a contour which is matched to the contour of a wedge-shaped region 18 below the transfer median line 12.1 of the two mutually cooperating cylinders 1 and 12. The storage device 6 includes a first planar storage region and an adjoining curved portion describing a run-on slope 30 facing the outer jacket surface 2 of the impression cylinder 1 which rotates counter-clockwise about the rotational axis 3 thereof. In the region facing the outer jacket surface 14 of the preceding or upline transfer cylinder 12, the storage device 6 likewise has a guide surface 20 curved according to the curvature of the outer jacket surface of the preceding or upline transfer cylinder 12.

Between the outer jacket surface 2 and a planar region, and also the curved regions 19 and 30 of the storage device 6, there extends a nip, which narrows continuously, as seen in the direction of entry of the sheet-like material 9. Illustrated in FIG. 2 is a first nip width 25.1, another nip width 25.2 which is smaller than the first nip width 25.2, and a further-narrowed nip width 25.3 which is formed between the outer jacket surface 2 and the run-on slope 30 of the storage device 6. Two copies of the sheet-like material 9 are illustrated in different conditions within the continuously narrowing nip between the outer jacket surface 2 of the impression cylinder 1 and the surface of the storage device 6. The sheet-like material 9 enters the continuously narrowing nip with a sheet edge 24, the sheet edge 24 constituting the old leading edge of the sheet-like material, which now forms the new trailing edge of the sheet-like material 9. In general, the sheet-like material 9, with the previously printed surface 10.1 thereof, outwardly faces the surface of the storage device 6, while that side 10.2 of the sheet-like material which is yet to be printed, faces towards the outer jacket surface 2 of the impression cylinder 1. The sheet-like material 9, which is nearer the outer jacket surface 2 of the impression cylinder 1, with respect to the outer surface, lies with the sheet edge 24 thereof on the run-on slope 30 of the storage device 6. A curvature is thereby imparted to the sheet-like material 9. A deformation 28 is imparted to the copy of the sheet-like material 9, the edge 24 of which is held by a retaining element 21 received in the wedge-shaped region 18, the deformation having the effect that the sheet-like material 9 fits snugly against the contour of the storage device 6, i.e., in particular, the curved portion 19 and the run-on slope 30. As a result, with the leading edge 24 stationary, the sheet-like material 9 can be bent, as shown, and received over the entire length thereof in the available storage space.

A retaining element 21 arranged in the wedge-shaped region 18 of the impression cylinder 1 and of the preceding or upline transfer cylinder 12 is formed with perforations, passing therethrough in an upper region thereof, the perforations being preferably configured in the manner of comb tines so that it is possible for holding devices received on the outer jacket surface 2 of the impression cylinder 1 to pass through them without difficulty. The retaining element 21 is formed by an end 22 which engages over the sheet edge 24 and which may be provided, on a side thereof coming into contact with the sheet edge 24, with an elastic coating, for example, of rubber. In addition to the application of an elastic coating on the end 22 of the retaining element 21 engaging beyond the sheet edge 24, the end 22 may also be provided with an encapsulated gel, by which different impact and damping characteristics, respectively, can be set, depending upon the consistency of the gel. In order to ensure that the sheet edge will reliably enter that end 22 of the retaining element 21, which engages beyond the sheet edge 24, ejector elements in the form of blowing nozzles or extendable pins 31 are provided on the outer jacket surface 2 of the impression cylinder 1. The nozzles or pins 31 are actuated, preferably cyclically controlled, after the instant of time at which the grippers open, so that the sheet edge 24 fits snugly against the run-on slope 30 of the storage device 6 below the overlapping end 22 of the retaining element 21. Alternatively, the storage device 6 may also be formed only of the retaining element 21 arranged in the wedge-shaped region. Moreover, it is possible for the storage device 6 to be constructed with interruptions running transversely or longitudinally to the direction of movement of the sheet-like material 9. In any event, the aforedescribed curved deformation 28 is imparted to the sheet-like material 9.

Figure 3:
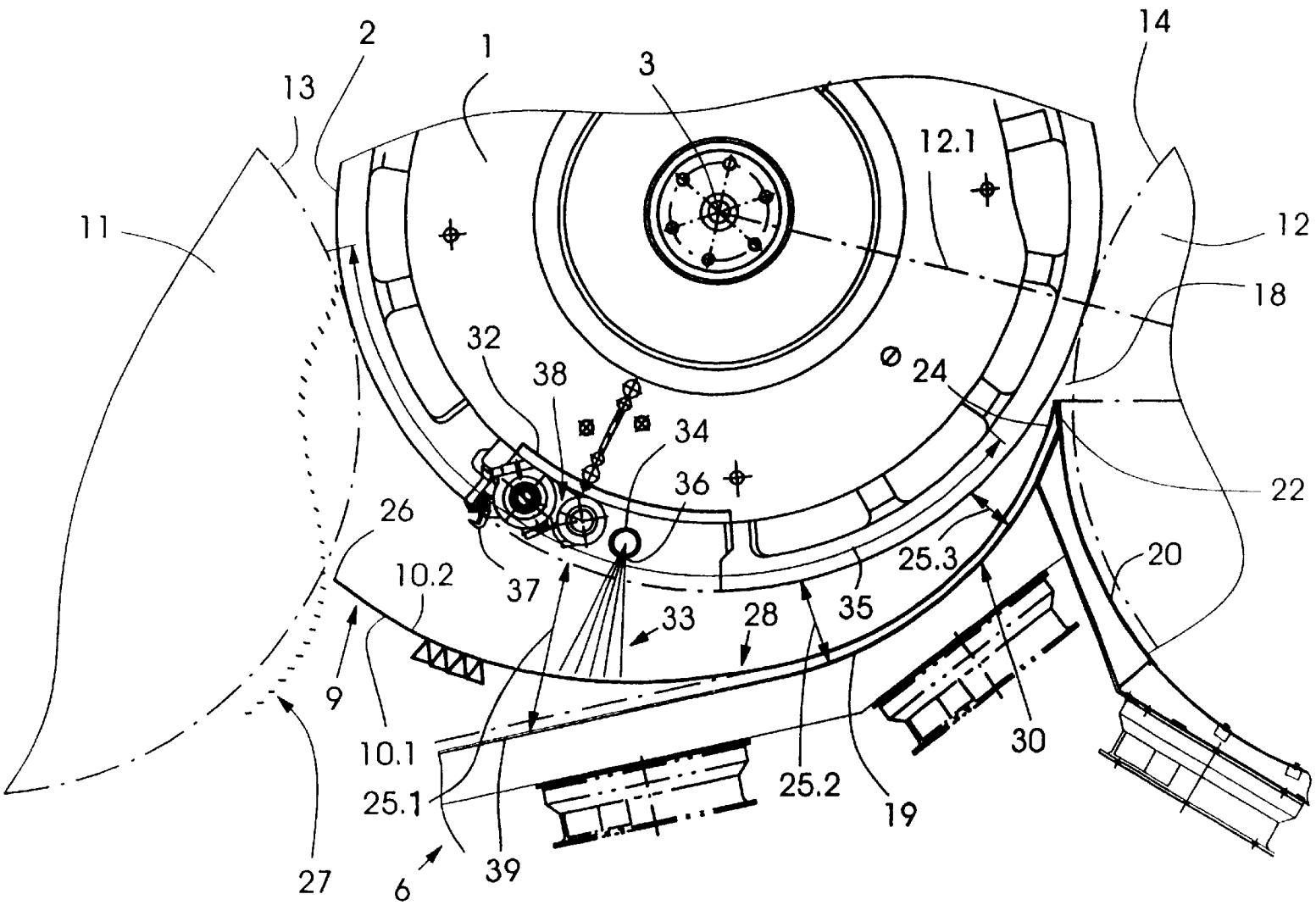
FIG. 3 is an enlarged fragmentary view of FIG. 1 showing a further embodiment of a device for deforming the sheet-like material by free jets.

Another different embodiment of the device for deforming the sheet-like material by free jets is illustrated in greater detail in FIG. 3.

The storage device 6 extending below the preceding or upline transfer cylinder 12, the impression cylinder 1 and the following or downline transfer cylinder 11 serving as a turning drum are shown in greater detail in FIG. 3. This storage device 6 has a planar region 39, a curved surface 19 and a run-on slope 30. A retaining element 21 with an end 22 engaging over or beyond the sheet trailing edge 24 is provided on the storage device 6 at the upper end thereof projecting into the wedge-shaped region 18.

In the region wherein the storage device 6 is assigned to the outer jacket surface 14 of the preceding or upline transfer cylinder 12, the storage device 6 is provided with a curved surface 20.

It is believed to be apparent from FIG. 3 that the retaining element 21 is located with the overlapping end 22 below the transfer median line 12.1 between the preceding or upline transfer cylinder 12 and the impression cylinder 1.

The various extents 25.1, 25.2 and 25.3 of the nip width between the surface of the storage device 6 and the outer jacket surface 2 of the impression cylinder 1 are shown decreasing continuously in a direction towards the transfer median line.

According to the embodiment shown in FIG. 3, a blowing or blast device 34 is contained in a channel 32, which is formed on the impression cylinder 1 for receiving the grippers 37 and their actuating unit 38. The outlet orifice 36 of the blowing device 34 faces that side 10.2 of the sheet-like material 9, which is yet to be printed. A bundle of free jets 33 emerges from the outlet orifice 34 of the blast tube 34 received in a gap or channel 32 formed in the impression cylinder 1 and causes a flexion 28 of the sheet-like material 9 in the region of the blast tube 34, so that a flexion 28 is produced. In addition to an emergence of free jets 33 from a blowing device, which is received in the channel 32 of the compression cylinder 1, deformation of the sheet-like material 9 may also take place, for example, via a touch-contact element such as, for example, a tappet or an oscillating lever. A deformation of the sheet-like material 9 is produced by the cyclic activation of the blast device 34 during the entry of the sheet-like material 9 with the sheet edge 24 thereof into the storage device 6, the printed side 10.1 facing the surface of the storage device. During the entry of the sheet-like material 9 into the storage device 6, the previous trailing edge 26 of the sheet-like material 9, which is now the new sheet leading edge, follows a path, which is identified at various instants of time in FIG. 3 by reference numeral 27. Reference numeral 35 identifies the maximum storable format length in the storage device 6 of the sheet-like material 9 which may be either cardboard or paper of light or heavier weight or grammage.

Figure 4:
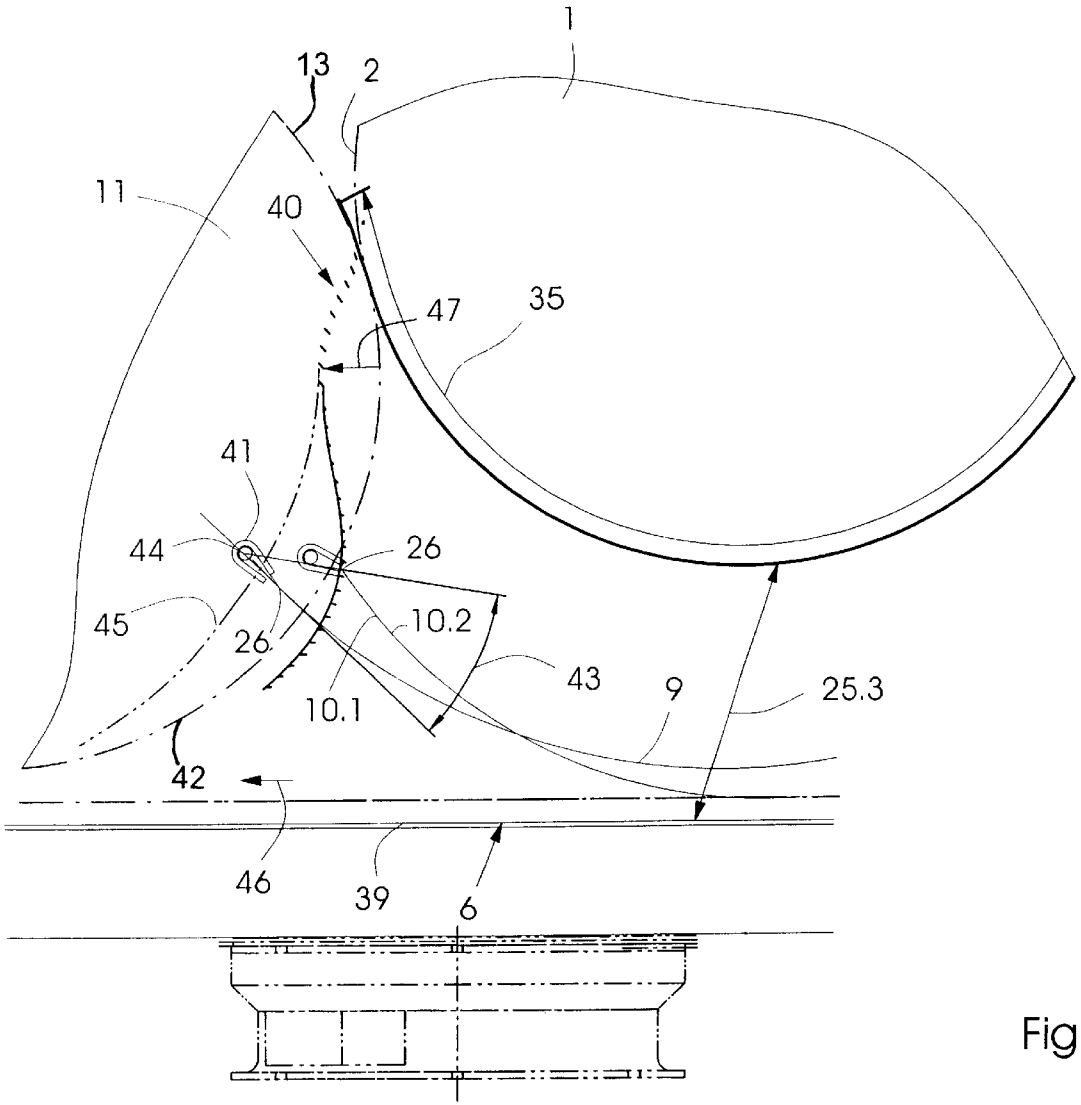
FIG. 4 is a further enlarged fragmentary view of FIG. 1 showing a further embodiment of the sheet-like material-deforming device having gripping elements integrated in the transfer cylinder following or located downline from the impression cylinder, for introducing a bending moment causing deformation of the sheet-like material.

FIG. 4 represents a further different embodiment of the invention, wherein a bending moment causing deformation of the sheet-like material 9 can be introduced into the latter by a gripper element integrated in the following or downline transfer cylinder, i.e., a turning or reversing drum. During the entry of the sheet-like material 9 in the direction of the arrow into the continuously narrowing nip between the outer jacket surface 2 of the impression cylinder 1 and the surface of the storage device 6, illustrated here with the planar region 39, a sheet edge 26 of the sheet-like material 9 is gripped by a gripping element 41. The gripping element 41 may be constructed, for example, as a tongs gripper, which is pivotable about an axis 44. The tongs gripper 41 received pivotably at the pivot axis 44 is guided, in a yielding movement running in accordance with reference numeral 40, within the enveloping curve of the outer jacket surface 13 of the following or downline transfer cylinder 11 functioning as a turning or reversing drum. When a rotation through an angle $\alpha$, identified by reference numeral 43, is imparted to the pivot axis 44 of the tongs gripper 41 during the yielding movement 40, a bending moment causing a deformation 28 of the sheet-like material 9 can be introduced into the sheet-like material 9 as a result of this rotation of the tongs gripper 41 about the pivot axis 44.

On the one hand, while the tongs gripper 41 is being guided along the gripper path 42 thereof in the yielding movement 40, this already results, within the following or downline transfer cylinder 11 functioning as a turning or reversing drum, in a length gain with regard to the storable length of the sheet-like material 9 and, on the other hand, by an assumption by the tongs gripper 41 of an inclined position through the angle $\alpha$ (reference numeral 43) about the axis 44 of the gripper 41, it is possible, within limits predetermined by the holding force, to introduce into the sheet-like material 9 a bending moment which can be utilized for the desired storage length gain by producing a deformation 28. When the gripper 41 assumes the profile 42 of the gripper path within the enveloping curve of the following or downline transfer cylinder 11 functioning as a turning or reversing drum, it also makes it possible to avoid the path 42, likewise depicted here, of the sheet trailing edge 26, the path being conducive to a collision, thus resulting in collision-free guidance of the sheet trailing edge with respect to the outer jacket surface 13 of the following or downline transfer cylinder 11 functioning as a turning or reversing drum. Reference numeral 45 designates the point of introduction of the bending moment into the sheet-like material 9, and the arrow 46 represents the direction of movement of the turned or reversed sheet-like material 9, which is conveyed out of the storage device 6 and is to be accelerated.

The change in distance 47, which describes the course 40 of the yielding movement of the gripper path 42 in relation to the outer jacket surface 13 of the following or downline transfer cylinder 11 functioning as a turning or reversing drum, varies continuously during the rotation of the following or downline transfer cylinder 11, the distance 47 being referred to herein being considered merely as an arbitrarily selected, instantaneously prevailing distance of the gripper path 42 from the outer jacket surface 13 of the following or downline transfer cylinder 11.

Figure 2:
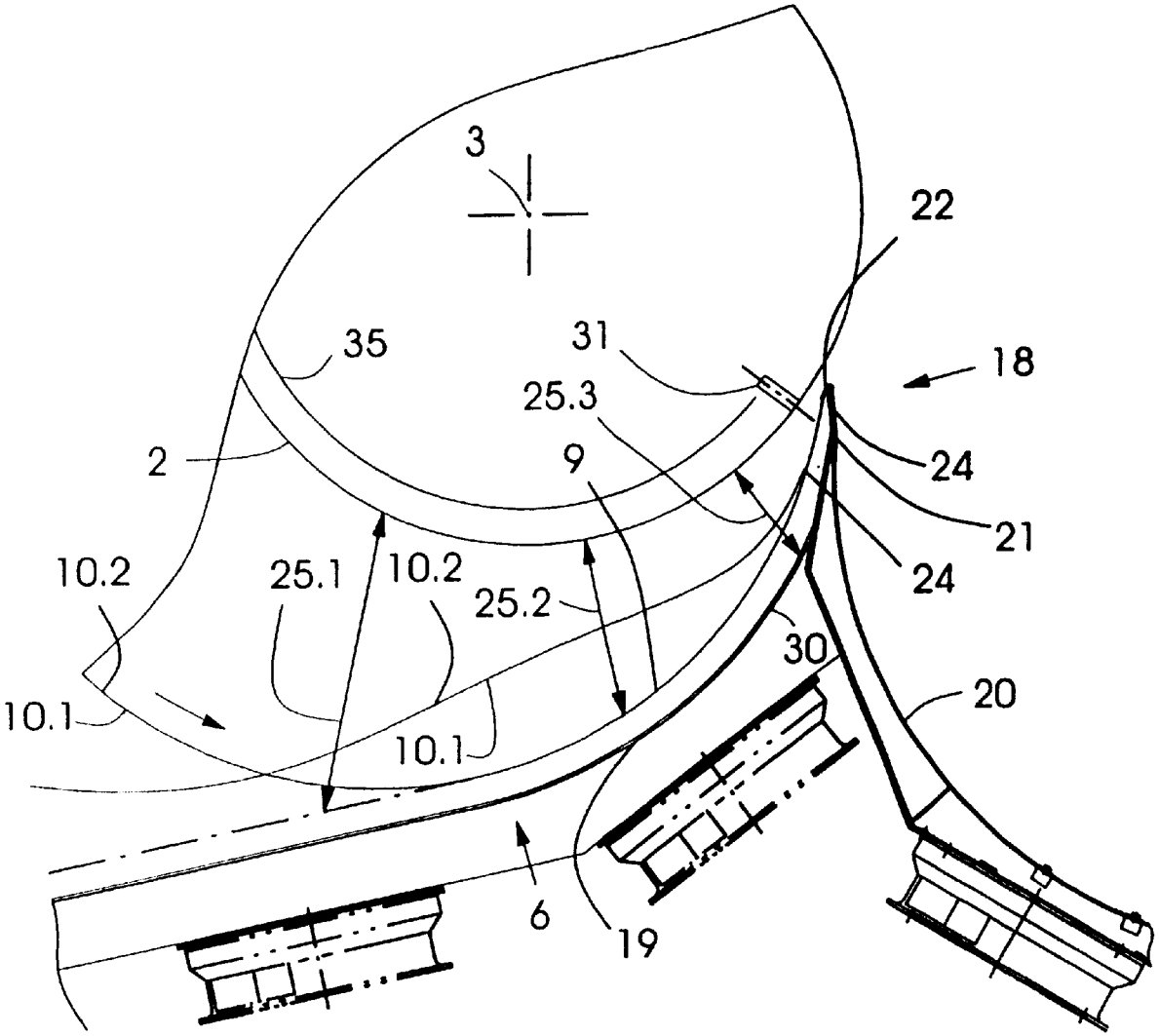
FIG. 2 is an enlarged fragmentary view of FIG. 1 showing another embodiment of the storage device according to the invention with a retaining element arranged in a wedge-shaped region below a transfer median line.

With the possible embodiments for implementing the concept upon which the invention is based, which are shown in FIGS. 2, and 4, the sheet-like material 9 can have imparted thereto a deformation in the form of a bend 28 which contributes to the storage length gain in the wedge-shaped region by the utilization of the wedge-shaped region of two cooperating cylinders. Furthermore, by the extent of curvature of the storage device 6 in the region of the curved surfaces 19 and 30, the storage length can be coordinated exactly with the maximum processable format 35 of the sheet-like material 9. The surface of the storage device 6 may be formed as a continuous curved plate. It is conceivable, furthermore, to implement the storage device 6 in the form of a multiplicity of round bars mounted adjacent to one another in mutually spaced relationship to one another.

I claim:

1. A method for storing a sheet-shaped material during a turning process, which comprises:

storing the sheet-shaped material on an impression cylinder connected with an upstream transfer cylinder and a downstream transfer cylinder, for printing the sheet-shaped material with a transmission cylinder;

guiding the sheet-shaped material, in a wedge-shaped region formed between the impression cylinder and the upstream transfer cylinder, by a storage device;

holding a leading edge of the sheet-shaped material by a gripping device of the impression cylinder and a trailing edge of the sheet-shaped material by a gripping device of the downstream transfer cylinder;

releasing the leading edge of the sheet-shaped material by the gripping device of the impression cylinder; and exerting external forces on the sheet-shaped material forming an additional bending in the sheet-shaped material.

* * * * *